US009731350B2

(12) United States Patent
Chan et al.

(10) Patent No.: US 9,731,350 B2
(45) Date of Patent: Aug. 15, 2017

(54) METHOD OF CASTING MONOCRYSTALLINE METAL PARTS

(75) Inventors: Celine Yanxi Chan, Paris (FR); Benoit Georges Jocelyn Marie, Neuilly sous Clermont (FR); David Locatelli, Eysines (FR)

(73) Assignee: SNECMA, Paris (FR)

( * ) Notice: Subject to any disclaimer, the term of this patent is extended or adjusted under 35 U.S.C. 154(b) by 156 days.

(21) Appl. No.: 14/237,982

(22) PCT Filed: Aug. 6, 2012

(86) PCT No.: PCT/FR2012/051852
§ 371 (c)(1),
(2), (4) Date: Feb. 10, 2014

(87) PCT Pub. No.: WO2013/021130
PCT Pub. Date: Feb. 14, 2013

(65) Prior Publication Data

US 2014/0193291 A1 Jul. 10, 2014

(30) Foreign Application Priority Data

Aug. 9, 2011 (FR) ..... 11 57264

(51) Int. Cl.

| | |
|---|---|
| ***B22D 27/00*** | (2006.01) |
| ***B22D 27/04*** | (2006.01) |
| ***B22D 29/00*** | (2006.01) |
| ***B22C 9/04*** | (2006.01) |

(52) U.S. Cl.
CPC ..... *B22D 27/04* (2013.01); *B22C 9/04* (2013.01); *B22D 27/00* (2013.01); *B22D 29/00* (2013.01)

(58) Field of Classification Search
CPC ..... B22D 27/00; B22D 27/04; B22D 29/00; B22D 19/00; B22D 19/009; B22C 9/04
USPC ..... 164/76.1, 129, 350
See application file for complete search history.

(56) References Cited

U.S. PATENT DOCUMENTS

| | | | | |
|---|---|---|---|---|
| 2,820,266 A | | 1/1958 | Kohl | |
| 3,494,709 A | * | 2/1970 | Piearcey | 416/232 |
| 4,116,723 A | | 9/1978 | Gell et al. | |
| 4,385,939 A | | 5/1983 | Kortovich et al. | |
| 4,639,280 A | | 1/1987 | Fredholm et al. | |

(Continued)

FOREIGN PATENT DOCUMENTS

| | | |
|---|---|---|
| DE | 2 450 602 A1 | 4/1975 |
| DE | 33 34 473 C1 | 1/1997 |

(Continued)

OTHER PUBLICATIONS

International Search Report Issued Oct. 17, 2012 in PCT/FR12/051852 Filed Aug. 6, 2012.

(Continued)

*Primary Examiner* — Jessee Roe
*Assistant Examiner* — John Hevey
(74) *Attorney, Agent, or Firm* — Oblon, McClelland, Maier & Neustadt, L.L.P.

(57) ABSTRACT

A foundry method of casting monocrystalline metal parts, the method including at least casting a molten alloy into a cavity of a mold through at least one casting channel in the mold, subjecting the alloy to heat treatment, and removing the mold, and wherein the heat treatment is performed before an end of mold removal.

15 Claims, 3 Drawing Sheets

(56) References Cited

U.S. PATENT DOCUMENTS

| | | | | |
|---|---|---|---|---|
| 5,064,990 | A * | 11/1991 | Tinsley | B22D 31/00 219/121.72 |
| 5,327,955 | A | 7/1994 | Easwaran | |
| 5,706,881 | A * | 1/1998 | Grunstra et al. | 164/76.1 |
| 6,364,001 | B1 | 4/2002 | Cross | |
| 7,093,645 | B2 * | 8/2006 | Grunstra et al. | 164/369 |
| 7,625,178 | B2 * | 12/2009 | Morris et al. | 416/97 R |
| 2005/0258577 | A1 | 11/2005 | Holowczak et al. | |
| 2010/0006253 | A1 | 1/2010 | Newcomb | |
| 2010/0272849 | A1 * | 10/2010 | Kaushal | B29C 45/03 425/547 |

FOREIGN PATENT DOCUMENTS

| | | | |
|---|---|---|---|
| EP | 0 079 692 | | 5/1983 |
| EP | 0 149 942 | | 7/1985 |
| EP | 0 149 942 | A2 | 7/1985 |
| EP | 0 570 271 | | 11/1993 |
| EP | 0 570 271 | A1 | 11/1993 |
| EP | 0 763 604 | | 3/1997 |
| EP | 0 763 604 | A1 | 3/1997 |
| EP | 2 027 952 | A2 | 2/2009 |
| GB | 2 286 786 | A | 8/1995 |
| JP | 2005-046857 | A | 2/2005 |
| RU | 2 254 962 | C1 | 6/2005 |

OTHER PUBLICATIONS

Chinese Office Action issued in Application No. 2012800389466 on Jan. 13, 2015 (English Translation).

Russian Office Action issued in Application No. 2014108855 on May 5, 2016 (English Translation).

Ivanov V. N.: Investment Pattern Casting, Moscow, 1984, p. 281, Para. 8.2, p. 285-D2 (w/ English Translation).

Timings et al., "Designing for Investment Casting." Manufacturing Technology, vol. 2, Second Edition, pp. 36-37 (Jul. 2000).

Donachie et al., "Superalloys," A Technical Guide, Second Edition, pp. 86-87, (Apr. 2008).

Siemens opposition to EP2741876 B1filed Sep. 5, 2016.

* cited by examiner

METHOD OF CASTING MONOCRYSTALLINE METAL PARTS

BACKGROUND OF THE INVENTION

The present invention relates to the foundry field, and in particular to casting monocrystalline metal parts.

Traditional metal alloys are equiaxed and polycrystalline: in the solid state, they form a plurality of grains of substantially identical size, typically of the order of 1 millimeter (mm), but of orientation that is random to a greater or lesser extent. The joints between grains constitute weak points in a metal part made of such an alloy. The use of additives for reinforcing these inter-grain joints nevertheless presents the defect of reducing the melting temperature, which is particularly troublesome when the parts produced in this way are for use at high temperature.

In order to solve that drawback, columnar polycrystalline alloys were initially proposed in which the grains solidify with a determined orientation. By orienting the grains in the direction of the main load on the metal part, that makes it possible to increase the strength of such parts in a particular direction. Nevertheless, even in parts subjected to forces that are strongly oriented along a particular axis, such as for example turbine blades that are subjected to centrifugal forces, it can still be advantageous to provide greater strength along other axes.

That is why, since the end of the 1970s, new so-called "monocrystalline" metal alloys have been developed that enable parts to be cast that are formed as single grains. Typically, such monocrystalline alloys are alloys of nickel with a concentration of titanium and/or aluminum of less than 10 molar percent (mol %). Thus, after solidification, those alloys form two-phase solids, with an upsilon ($\gamma$) first phase and an upsilon prime ($\gamma'$) second phase. The $\gamma$ phase has a face centered cubic crystal lattice in which the atoms of nickel, aluminum, and/or titanium can occupy any position. In contrast, in the $\gamma'$ phase, the atoms of aluminum and/or titanium form a cubic configuration, occupying the eight corners of the cube, while the atoms of nickel occupy the faces of the cube.

One of these new alloys is the "AM1" nickel alloy developed jointly by Snecma, les laboratoires de l'ONERA, l'Ecole des Mines de Paris, and Imphy SA. The parts made out of such an alloy can not only achieve particularly high levels of mechanical strength along all force axes, but they also present improved ability to withstand high temperatures, since they do not need any additives for binding their crystal grains together more strongly. Thus, metal parts produced on the basis of such monocrystalline alloys can advantageously be used in the hot portions of turbines, for example.

Nevertheless, even when using such special alloys, it can be difficult to avoid a recrystallization phenomenon during the production of such parts, giving rise once more to crystal grains and to new weak points in the part. In a conventional foundry method, the molten alloy is cast into a cavity in a mold through at least one casting channel in the mold, the mold is removed after the alloy has solidified so as to release the part, and the part is then subjected to heat treatment, such as quenching for example, in which the metal is initially heated in order to be subsequently cooled rapidly so as to homogenize the $\gamma$ and $\gamma'$ phases in the monocrystal without causing it to melt.

Nevertheless, the mechanical impacts to which the parts are subjected after casting can locally destabilize the crystal lattice of the monocrystal. Thereafter, the heat treatment can trigger unwanted recrystallization in the locations that have been destabilized in that way, thereby losing the monocrystalline nature of the part and giving rise to points of weakness therein. Even while making considerable efforts, it is very difficult to avoid mechanical impacts in the handling of molds that may weigh several tens of kilograms, particularly since removal of the mold of itself involves the use of mechanical blows. Furthermore, on its own, a limited reduction in the temperature of the heat treatment does not make it possible to prevent those recrystallization phenomena significantly.

OBJECT AND SUMMARY OF THE INVENTION

The present invention seeks to remedy those drawbacks. For this purpose, the invention seeks to propose a casting method that makes it possible to limit to a great extent the phenomena of recrystallization following the heat treatment of the parts after the alloy cast into the mold has solidified.

This object is achieved by the fact that, in a foundry method in at least one implementation of the invention, the heat treatment is performed after the alloy has solidified in the mold but before the end of mold removal.

By means of these provisions, the heat treatment is performed before operations that might weaken the crystal structure of the monocrystal forming the part. Although the person skilled in the art might have thought that the presence of at least some remaining portions of the mold during the heat treatment would make the heat treatment less effective, it has been found that it is possible to perform the heat treatment earlier in this way without harmful effects on the metal part, and that on the contrary performing this heat treatment earlier makes it possible to avoid unwanted recrystallization occurring during the heat treatment.

In particular, if said removal of the mold comprises a first step of removal by hammering and a subsequent step of removal by water jet, said heat treatment may advantageously be performed at least before the water jet removal, which is found often to be the source of the recrystallization phenomena that occur during heat treatment performed subsequently.

In alternative implementations, it is nevertheless possible to envisage performing the heat treatment even before initial removal of the mold. Under such circumstances, such recrystallization phenomena should be combated by other means, in particular geometrical means.

In a second aspect of the present invention, said casting channel may include at least one transition zone adjacent to said cavity, the transition zone having a rounded portion of radius not less than 0.3 mm between said casting channel and said cavity in order to avoid a sharp bend in the flow of the molten alloy, which bend could give rise to a zone of recrystallization in the alloy. In particular, in this zone, the casting channel may present a section that is enlarged relative to an upstream section in the direction of a main axis of a section of the cavity that is perpendicular to the casting channel. More particularly, after casting, this transition zone may form at least one metal web that is thinner than the casting channel upstream, and more particularly at least one such metal web on each of two opposite sides of the casting channel. When the mold contains at least one core penetrating into said cavity and occupying a space adjacent to said casting channel for the purpose of forming a cavity in the metal part, said transition zone, after casting, may form at least one metal web adjacent to said core and thinner than the casting channel upstream. Each metal web adjacent to the core may present an outer edge following a substantially concave line adjacent on a surface of the core. The transition zone may form at least one metal web on each side of said core. Under such circumstances, said adjacent metal webs of the core may present outer edges that join together at their ends, so as to go around the core.

In this way, during casting, this transition zone makes it possible to fill the cavity in substantially simultaneous manner over its entire width, thereby avoiding irregularities being created in the crystal structure of the monocrystal during solidification of the alloy. During the heat treatment step, such irregularities could give rise to local recrystallization, thereby forming a weak point in the metal part.

In order to increase the production of metal parts, the mold may contain a plurality of cavities arranged like a bunch of grapes, so as to mold a plurality of metal parts simultaneously.

The method of the invention is particularly suitable for producing certain metal parts, such as turbine engine blades. The present invention also provides metal parts obtained by the method.

BRIEF DESCRIPTION OF THE DRAWINGS

The invention can be well understood and its advantages appear better on reading the following detailed description of an implementation given by way of non-limiting example. The description refers to the accompanying drawings, in which.

DETAILED DESCRIPTION OF THE INVENTION

Figure 1:
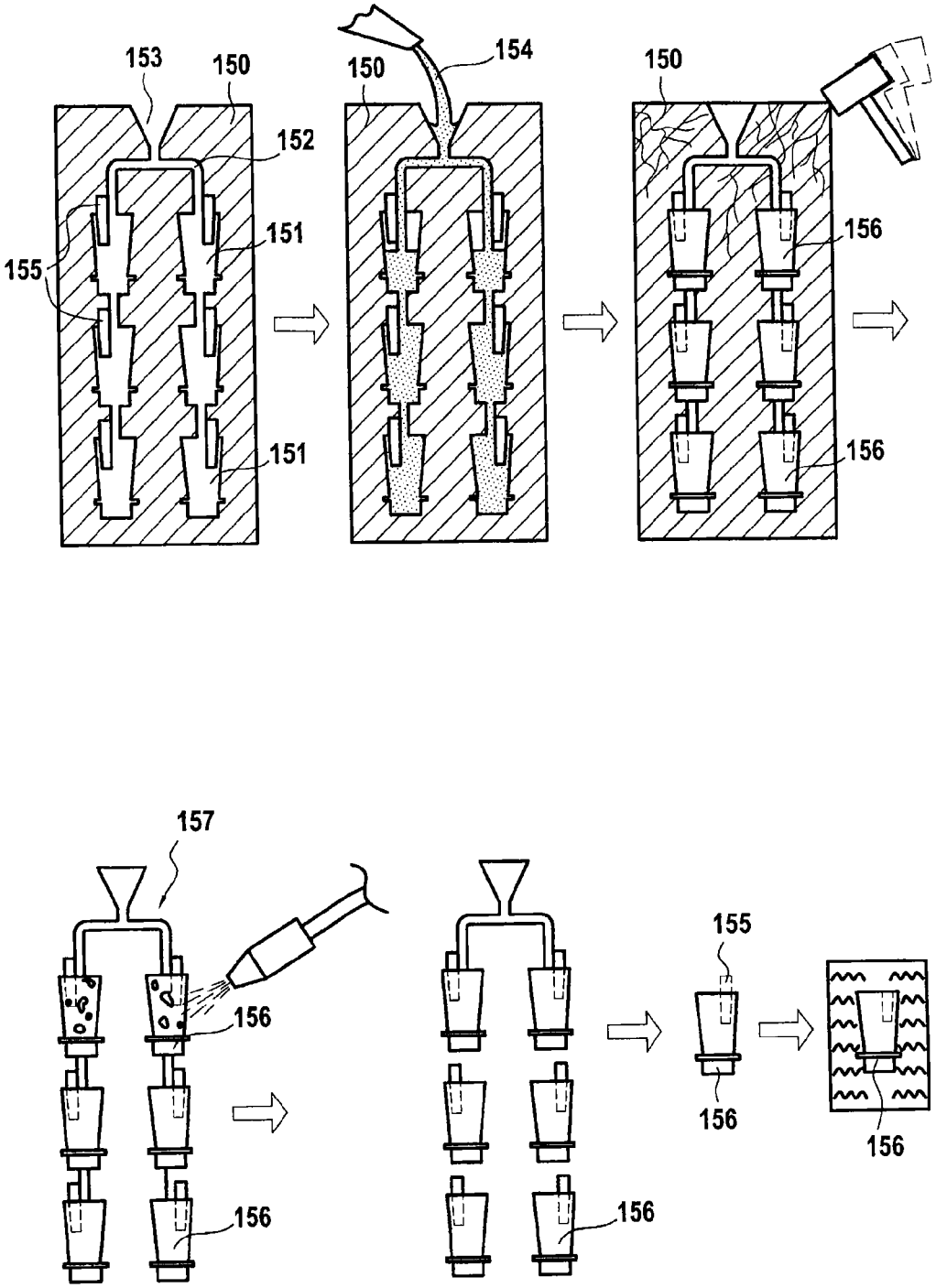
FIG. 1 shows a prior art foundry method.

A conventional foundry method, e.g. as used in the production of turbine engine blades and more particularly high pressure turbine blades is shown in FIG. 1. In a first step, a ceramic mold 150 is produced, typically by the lost wax method, although other conventional methods could alternatively be used. The ceramic mold 150 has a plurality of cavities 151 connected by means of casting channels 152 to an external orifice 153 of the mold 150. Each cavity 151 is shaped to mold a metal part that is to be produced. Under such circumstances, since the parts to be produced are hollow, the mold 150 also includes cores 155 penetrating into each of the cavities 151. After this first step, in a casting step, a molten alloy 154 is poured into the orifice 153 in order to fill the cavities 151 via the casting channels 152.

After the alloy has solidified, in a third step, initial removal of the mold 150 is performed by hammering in order to release the metal parts 156 united as a bunch 157 from the mold 150. In order to eliminate the last remains of the mold 150, an additional step is then performed of removal by water jet. In the following step S105, the individual parts 156 are cut away from the bunch 157. The cores 155 are then removed from each of the parts 156 in the following step, and the parts 156 are finally subjected to heat treatment. By way of example, this heat treatment may be quenching, in which the parts 156 are briefly heated and then cooled rapidly in order to harden the alloy of the part.

The alloys that can be used in this method include in particular so-called "monocrystalline" alloys that enable a part to be formed as a single crystal grain, or "monocrystal". Nevertheless, in that prior art method, the heat treatment for the purpose of homogenizing the $\gamma$ and $\gamma'$ phases of the monocrystal can trigger recrystallization phenomena that weaken the parts locally. In order to avoid that drawback, in a foundry method in an implementation of the invention as shown in FIG. 2, the order of the operations is modified by performing the heat treatment step earlier.

Figure 2:
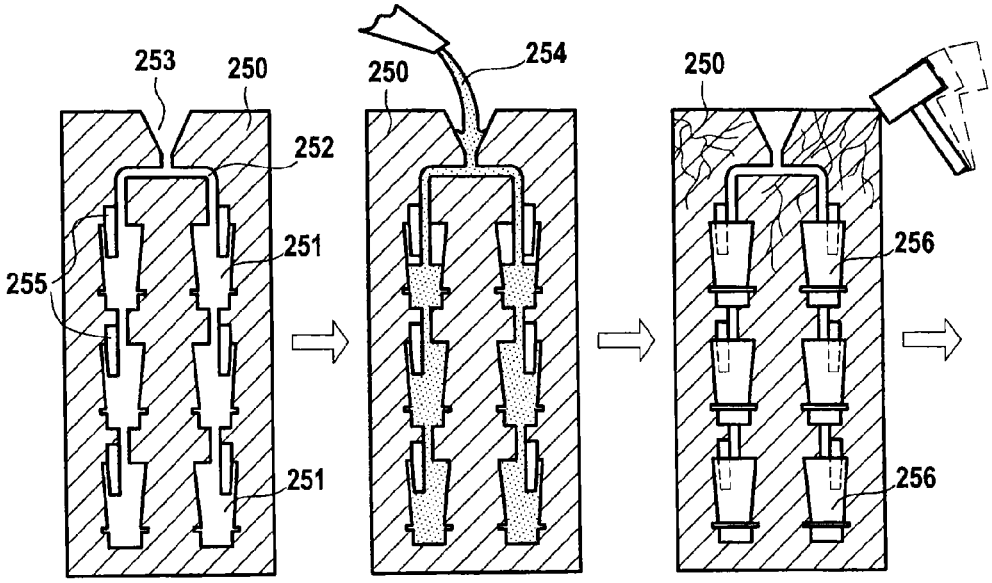
FIG. 2 shows a foundry method in an implementation of the present invention.
Figure 2:
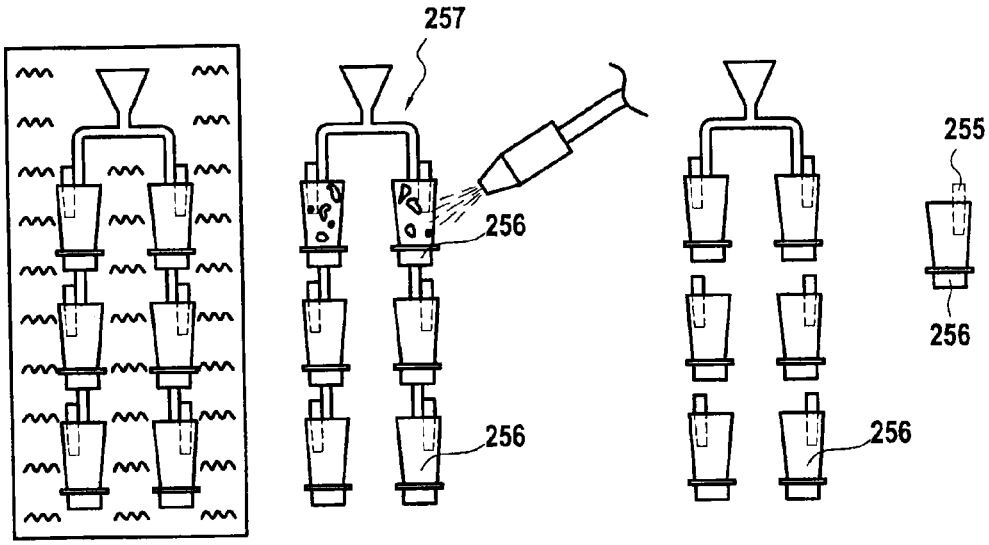

Thus, in this method shown in FIG. 2, the first step is likewise producing a ceramic mold 250. As in the prior art, the ceramic mold 250 may also be produced by the lost wax method, or by some alternative method selected from those known to the person skilled in the art. In addition, and as in the prior art, the ceramic mold 250 has a plurality of cavities 251 connected by casting channels 252 to an external orifice 253 of the mold 250. Each cavity 251 is also shaped for molding a metal part that is to be produced. In addition, since the parts to be produced are also hollow, the mold 250 also includes cores 255 penetrating into each of the cavities 251.

After the first step, and still as in the prior art, a molten alloy 254 is cast into the orifice 253 during a casting step in order to fill the cavities 251 via the casting channel 252. After the alloy has solidified, in a third step, initial removal of the mold 250 by hammering is likewise performed in order to release the metal parts 256 united as a bunch 257 from the mold 250. Nevertheless, in this method, after this initial removal, the heat treatment step is performed directly. During the heat treatment, the metal parts 256, still constituting a bunch 257 and still together with remaining pieces of the mold 250 are subjected directly to quenching, for example, in which the parts 256 are briefly heated and then rapidly cooled.

In order to eliminate the last remains of the mold 250, it is possible in the following step to then proceed with removal by water jet. Finally, the individual parts 256 are cut away from the bunch 257 and the cores 255 are then removed from each of the parts 256, which parts have already been subjected to heat treatment before removal by water jet.

Figure 3:
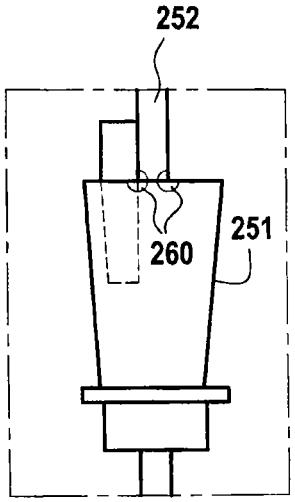
FIG. 3 shows the connection between a casting channel and a molding cavity in a prior art mold.

Because the heat treatment step is performed earlier, it is possible to reduce recrystallization phenomena during this step. Nevertheless, in order to reduce this recrystallization even more completely and above all in order to do so reliably, it is also appropriate to give the casting channels 252 an appropriate shape. In FIG. 3, there can be seen the connection between a casting channel 152 and a mold cavity 151 in the prior art mold 150. This connection forms very sharp bends between the channel 152 and the cavity 151, which bends can lead to recrystallization zones 160 forming during the heat treatment.

Figure 4:
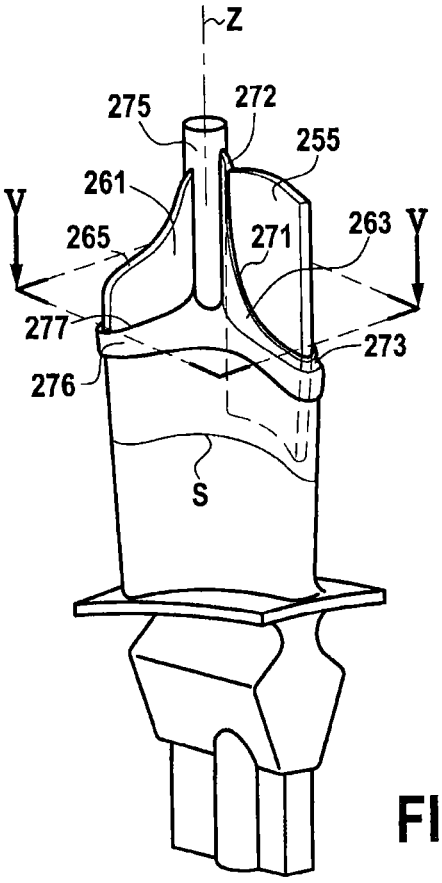
FIG. 4 is a perspective view of a metal part produced using the method of FIG. 2.
Figure 5:
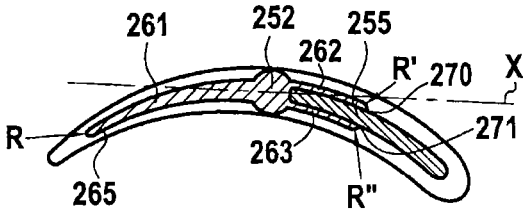
FIG. 5 is a cross-section on plane V-V of the metal part shown in FIG. 4.

In the mold 250 of the method shown in FIG. 2, in order to avoid forming such recrystallization zones in each part 256 around the casting channels 252, the channels 252 may include transition zones adjacent to the cavities 251. In a transition zone, the casting channel 252 becomes progressively enlarged towards a main axis X of a section S of the cavity 251 in a plane A that is perpendicular to the casting channel in such a manner that the radius of the rounded portion between the casting channel 252 and the cavity 251 is not less than 0.3 mm. In particular, in the implementation shown, in which the mold 250 also includes a core 255 adjacent to the casting channel 252, this transition zone enlarges on either side of the core 255, and also away from the core 255. When the cavity 251 and the channel 252 are filled with metal, the metal thus forms a web 261 away from the core 255 and two webs 262 and 263 that are adjacent to the core 255, one on either side of the core 255, as shown in FIGS. 4 and 5. Perpendicularly to the axis X, these webs 261, 262, and 263 are substantially thinner than is the casting channel 252 upstream from the transition zone.

During the casting step, the presence of the transition zone thus makes it possible to distribute the flow of molten alloy substantially throughout the width of the cavity 251, thus avoiding subsequent formation of recrystallization zones.

The monocrystalline part 256 shown in FIG. 4 is a turbine blade. It is shown in its rough state after unmolding, i.e. with the metal that has solidified outside the part in the casting channel 252. This metal thus forms a central rod 275, webs 261, 262, and 263, and an enlarged section 276 adjacent to the blade tip 265. During casting, the molten alloy flows from the blade tip 265, through the blade root 266 and on to a casting channel 252 connected to another cavity 251 further downstream. The flow of molten alloy thus follows substantially the direction of the main axis Z of the blade. The web 261 that extends towards the trailing edge 267 of the blade presents an outer edge 268 with a concave upstream segment and a convex downstream segment. In cross-section, this outer edge 268 has a radius of curvature R that varies only very gradually from the central rod 275 to the enlarged section 276. The webs 262 and 263 that extend towards the leading edge 269 of the blade on either side of the core 255 present respective outer edges 270 and 271 that are substantially concave and that run along the core 255. These outer edges 270 and 271 join together via their ends above the core 255 and in front of it, thereby forming two connections 272, 273 so as to surround the core 255. In cross-section, the webs 262, 263 present radii of curvature R' and R" on the surfaces adjacent to the outer edges 270, 271 so as to avoid seeding undesirable metallurgical defects in the proximity of the core 255. The transition surfaces 277 of the webs 261, 262, and 263 and of the rod 275 at the enlarged section 276 are likewise rounded to avoid seeding such defects.

Among the alloys that can be used in this method, there are in particular monocrystalline alloys of nickel, such as in particular AM1 and AM3 from Snecma, and also others such as CMSX-2®, CMSX-4®, CMSX-6®, and CMSX-10® from C-M Group, René® N5 and N6 from General Electric, RR2000 and SRR99 from Rolls-Royce, and PWA 1480, 1484, and 1487 from Pratt & Whitney, among others. Table 1 gives the compositions of these alloys.

TABLE 1

Compositions of monocrystalline nickel alloys in weight %

| Alloy | Cr | Co | Mo | W | Al | Ti | Ta | Nb | Re | Hf | C | B | Ni |
|---|---|---|---|---|---|---|---|---|---|---|---|---|---|
| CMSX-2 | 8.0 | 5.0 | 0.6 | 8.0 | 5.6 | 1.0 | 6.0 | — | — | — | — | — | Bal |
| CMSX-4 | 6.5 | 9.6 | 0.6 | 6.4 | 5.6 | 1.0 | 6.5 | — | 3.0 | 0.1 | — | — | Bal |
| CMSX-6 | 10.0 | 5.0 | 3.0 | — | 4.8 | 4.7 | 6.0 | — | — | 0.1 | — | — | Bal |
| CMSX-10 | 2.0 | 3.0 | 0.4 | 5.0 | 5.7 | 0.2 | 8.0 | — | 6.0 | 0.03 | — | — | Bal |
| René N5 | 7.0 | 8.0 | 2.0 | 5.0 | 6.2 | — | 7.0 | — | 3.0 | 0.2 | — | — | Bal |
| René N6 | 4.2 | 12.5 | 1.4 | 6.0 | 5.75 | — | 7.2 | — | 5.4 | 0.15 | 0.05 | 0.004 | Bal |
| RR2000 | 10.0 | 15.0 | 3.0 | — | 5.5 | 4.0 | — | — | — | — | — | — | Bal |
| SRR99 | 8.0 | 5.0 | — | 10.0 | 5.5 | 2.2 | 12.0 | — | — | — | — | — | Bal |
| PWA1480 | 10.0 | 5.0 | — | 4.0 | 5.0 | 1.5 | 12.0 | — | — | — | 0.07 | — | Bal |
| PWA1484 | 5.0 | 10.0 | 2.0 | 6.0 | 5.6 | — | 9.0 | — | 3.0 | 0.1 | — | — | Bal |
| PWA1487 | 5.0 | 10.0 | 1.9 | 5.9 | 5.6 | — | 8.4 | — | 3.0 | 0.25 | — | — | Bal |
| AM1 | 7.0 | 8.0 | 2.0 | 5.0 | 5.0 | 1.8 | 8.0 | 1.0 | — | — | — | — | Bal |
| AM3 | 8.0 | 5.5 | 2.25 | 5.0 | 6.0 | 2.0 | 3.5 | — | — | — | — | — | Bal |

Although the present invention is described with reference to a specific implementation, it is clear that various modifications and changes may be made to that implementation without going beyond the general scope of the invention as defined by the claims. For example, in an alternative implementation, the heat treatment could be performed even before initial removal of the mold. In addition, the individual characteristics of the various implementations of the method may be combined in additional implementations. Consequently, the description and the drawings should be considered in an illustrative sense rather than in a restrictive sense.

The invention claimed is:

1. A foundry method of casting monocrystalline metal parts, the method comprising:

casting a molten alloy into a cavity of a mold through at least one casting channel in the mold, wherein the cavity is shaped for molding a final metal part;

subjecting the alloy to heat treatment; and removing the mold;

wherein the heat treatment is performed after the alloy has solidified in the mold and before an end of mold removal, wherein the casting channel includes at least one transition zone adjacent to the cavity, and presents, in the transition zone, relative to an upstream section of the casting channel in a flow direction of the molten alloy, a cross-section that is enlarged in a direction of a main axis of a section of the cavity in a plane that is perpendicular to the casting channel, wherein, after the casting, the transition zone forms, adjacent to the final metal part formed by the cavity, an enlarged section, a central rod formed by the casting channel upstream from the enlarged section, and at least one metal web connected to the central rod and the enlarged section, the at least one metal web being thinner than the central rod, wherein the metal part is a turbine engine blade, and wherein the enlarged section is adjacent to a blade tip of the turbine blade.

2. A foundry method according to claim 1, wherein the removal of the mold comprises a first removal by hammering and a subsequent removal by water jet, the heat treatment being performed at least before the removal by water jet.

3. A foundry method according to claim 1, wherein the transition zone has a rounded portion of radius not less than 0.3 mm between the casting channel and the cavity.

4. A foundry method according to claim 1, wherein, after the casting, the transition zone forms at least one metal web on each of two opposite sides of the central rod, which at least one metal web is thinner than the central rod.

5. A foundry method according to claim 1, wherein the mold includes at least one core penetrating into and protruding from the cavity and occupying a space adjacent to the casting channel to form a cavity in the final metal part.

6. A foundry method according to claim 5, wherein, after casting, the transition zone forms at least one metal web adjacent to the core on each of two opposite sides of the core.

7. A foundry method according to claim 1, wherein the mold includes a plurality of cavities arranged as a bunch to mold a plurality of metal parts simultaneously.

8. A monocrystalline metal part produced by a foundry method according to claim 1.

9. A foundry method of casting monocrystalline metal parts, the method comprising:

casting a molten alloy into a cavity of a mold through at least one casting channel in the mold, wherein the cavity is shaped for molding a final metal part;

subjecting the alloy to heat treatment; and removing the mold;

wherein the casting channel includes at least one transition zone adjacent to the cavity, and presents, in the transition zone, relative to an upstream section of the casting channel in a flow direction of the molten alloy, a cross-section that is enlarged in a direction of a main axis of a section of the cavity in a plane that is perpendicular to the casting channel, wherein, after the casting, the transition zone forms, adjacent to the final metal part formed by the cavity, an enlarged section, a central rod formed by the casting channel upstream from the enlarged section, and at least one metal web connected to the central rod and the enlarged section, the at least one metal web being thinner than the central rod, wherein the metal part is a turbine engine blade, and wherein the enlarged section is adjacent to a blade tip of the turbine blade.

10. A foundry method of casting monocrystalline parts according to claim 9, wherein, after the casting, the transition zone forms at least one metal web on each of two opposite sides of the central rod, which at least one metal web is thinner than the central rod.

11. A foundry method of casting monocrystalline metal parts according to claim 9, wherein the mold includes at least one core penetrating into and protruding from the cavity and occupying a space adjacent to the casting channel to form a cavity in the final metal part.

12. A foundry method of casting monocrystalline metal parts according to claim 11, wherein the metal web adjacent to the core presents an outer edge following a substantially concave line adjacent on a surface of the core.

13. A foundry method of casting monocrystalline metal parts according to claim 11, wherein, alter casting, the transition zone forms at least one metal web adjacent to the core on each of two opposite sides of the core.

14. A foundry method of casting monocrystalline metal parts according to claim 13, wherein the metal webs adjacent to the core present outer edges that join together at ends to surround the core.

15. A foundry method of casting monocrystalline metal parts according to claim 9, wherein the transition zone has a rounded portion of radius not less than 0.3 mm between the casting channel and the cavity.

* * * * *